United States Patent [19]

Norton

[11] Patent Number: 4,464,645

[45] Date of Patent: Aug. 7, 1984

[54] ANGULAR DISPLACEMENT TRANSDUCER OF THE VARIABLE RELUCTANCE TYPE

[76] Inventor: Peter Norton, 170 Beaver Brook, Lincoln Park, N.J. 07035

[21] Appl. No.: 405,786

[22] Filed: Aug. 6, 1982

[51] Int. Cl.[3] ..... H01F 21/06

[52] U.S. Cl. ..... 336/135; 336/130; 336/132; 336/134

[58] Field of Search ..... 336/30, 130, 132, 134, 336/135

[56] References Cited

U.S. PATENT DOCUMENTS

| | | | |
|---|---|---|---|
| 2,840,779 | 6/1958 | Renaut | 336/134 X |
| 3,146,418 | 8/1964 | Maeda | 336/134 |
| 3,168,716 | 2/1965 | Szalay | 336/135 X |
| 3,329,012 | 7/1967 | Demuth | 336/30 X |
| 3,340,729 | 9/1967 | Scoppe | 336/30 X |
| 3,562,687 | 2/1971 | Tavis | 336/30 |
| 4,031,496 | 6/1977 | Fujiwara et al. | 336/134 X |

*Primary Examiner*—G. P. Tolin
*Assistant Examiner*—S. Steward
*Attorney, Agent, or Firm*—Reising, Ethington, Barnard, Perry & Milton

[57] ABSTRACT

An angular displacement transducer of the variable reluctance type is disclosed. It utilizes two relatively rotatable rotors with two sets of magnetic circuits and a coil associated with each magnetic circuit. Each set of magnetic circuits has a set of magnetic cores, one-half the cores on one rotor and one-half on the other rotor. A pair of cores in the first set, one on each rotor, coact with each other to provide a first variable reluctance magnetic circuit which is magnetically linked with the first coil and which has a reluctance that varies with relative rotation of the rotors. A pair of cores in the second set, one on each rotor, coact with each other to provide a second variable reluctance magnetic circuit which is magnetically linked with the second coil and which has a reluctance that varies with relative rotation of the rotors. The pairs of cores in the first and second sets are arranged so that relative rotation of the rotors causes the reluctance of the first magnetic circuit to increase while the reluctance of the second magnetic circuit is decreasing, and vice-versa.

11 Claims, 13 Drawing Figures

ANGULAR DISPLACEMENT TRANSDUCER OF THE VARIABLE RELUCTANCE TYPE

FIELD OF THE INVENTION

This invention relates to displacement transducers and more particularly, to transducers of the variable reluctance type for producing an electrical signal indicative of angular displacement.

BACKGROUND OF THE INVENTION

In measurement and control systems, various types of displacement transducers are used for producing an electrical signal corresponding to angular displacement. The prior art includes a wide variety of such transducers including those which are characterized as resistive, capacitive and inductive. The inductive type of displacement transducer, in general, utilizes a variation of magnetic reluctance to produce a variation of inductance. The variable inductance may be utilized to produce variation of impedance or of transformer coupling.

A particular application for angular displacement transducers is that of torque sensing in power steering systems for automotive vehicles. In this particular application, the variable reluctance transducer is especially well suited to the rugged environment of the automobile steering system.

The prior art includes a variety of variable reluctance displacement transducers. The Demuth U.S. Pat. No. 3,329,012 discloses a torque measuring or control device comprising a pair of metal disks which are mounted on separate shafts, the shafts being connected by a flexure element which permits limited relative rotation. The disks extend into the air gap of a differential transformer and the disks are provided with openings which overlap to an extent depending upon the torque. The degree of overlap determines the coupling of the transformer windings and hence the output voltage.

The Scoppe U.S. Pat. No. 3,340,729 describes an electromagnetic torque meter which utilizes a magnetostrictive sleeve on a rotating shaft with stationary primary and secondary windings adjacent the sleeve. The signal induced in the secondary winding is a function of the permeability of the sleeve which is varied by the torque applied to the shaft.

The Tavis U.S. Pat. No. 3,562,687 describes a variable reluctance transducer especially adapted for pressure sensing. A magnetic core includes spaced legs which extend radially from a center pole to define a U-shaped channel in which an energizing coil is fitted. Enlarged arcuate tabs extend laterally from the ends of the legs to form a segmented outer pole on the core. A movable armature in the form of a diaphragm is spaced from the poles and is displaced toward or away from the poles in accordance with the variations in the fluid pressure being sensed. Accordingly, the reluctance of the magnetic circuit is varied according to pressure variations.

There is a need for an angular displacement transducer of the electrical type which is capable of producing a highly stable displacement signal under all operating conditions. In particular, it must have a reference or zero position which produces a reference signal value which is substantially invariant with ambient conditions such as temperature, shock and vibration so that false signals are not generated. This is especially important for a transducer to be used in automotive power steering to avoid unwanted steering activation. Further, a transducer for power steering should be compact, lightweight and of rugged construction. It should also lend itself to low cost manufacture in mass production.

A general object of this invention is to provide a transducer which meets the foregoing requirements and which overcomes certain disadvantages of the prior art.

SUMMARY OF THE INVENTION

In accordance with this invention, a transducer of the variable reluctance type is provided which produces an angular displacement signal with a high degree of stability. In particular, the signal varies as a function of the relative angular displacement of the transducer rotors but is substantially invariant with other relative movements of the rotors and with variations in temperature and other ambient conditions. This is accomplished by utilizing a pair of variable reluctance magnetic circuits which vary the inductance of respective coils in opposite senses in response to angular displacements. The pair of magnetic circuits are mounted commonly so that they both sense the same relative motion. The inductance variations are combined differentially to obtain a displacement signal and to nullify the effect of unwanted relative motion and the effect of temperature changes.

Further, according to this invention, a variable reluctance angular displacement transducer is provided which has rotatable magnetic circuits and a non-rotating coil for developing a displacement signal without need for brushes, slip rings or a flexible conductor for conducting the signal to associated circuits. This is accomplished by using a stationary coil holder with coils thereon disposed in magnetic coupling arrangement with the magnetic circuit.

Further, according to this invention, the magnetic circuits comprises first and second relatively rotatable members having opposed mating faces. There are first and second sets of cores with one-half of each set being on the first member and one-half of each set being on the second member. Each core terminates in a pair of pole faces. A pair of cores in the first set, one on each member, coact to provide a first magnetic circuit with an air gap between the pole faces and a pair of cores in the second set, one on each member, coact to provide a second magnetic circuit with an air gap between the pole faces. Preferably, the pole faces are thin, shaped plates and opposing pole faces are spaced by a narrow air gap. A first conductor coil is magnetically linked with the first magnetic circuit and a second conductor coil is magnetically linked with the second magnetic circuit. The pole faces of the cores in the first set are positioned on the respective members so that relative rotation thereof between first and second predetermined angular positions causes the degree of face-to-face overlap to vary between a maximum and a minimum in the respective positions whereby the reluctance of the first magnetic circuit is variable between a minimum and a maximum. Similarly, the pole faces of the cores in the second set are positioned on the respective members so that relative rotation between said first and second predetermined angular positions causes the degree of face-to-face overlap of the pole faces to vary between a minimum and a maximum in the respective positions whereby the reluctance of the second magnetic circuit is variable between a maximum and a minimum. The pole faces of the first set of cores and the pole faces of the second set of cores are located on said members so that relative rotation which causes the reluctance of one of the magnetic circuits to increase causes the reluctance of the other magnetic circuit to decrease.

Further, according to this invention, there are a plurality of pairs of cores in the first set and a plurality of pairs of cores in the second set to provide plural magnetic circuits. The cores in each set are spaced equidistantly in the circumferential direction. Also, the magnetic circuits formed by the cores of the first set may by physically separated from the magnetic circuits formed by the cores of the second set. Preferably, each core comprises ferromagnetic material having a core body terminating in a pair of pole faces.

A more complete understanding of this invention may be obtained from the detailed description that follows taken with the accompanying drawings.

BEST MODE FOR CARRYING OUT THE INVENTION

Figure 1:
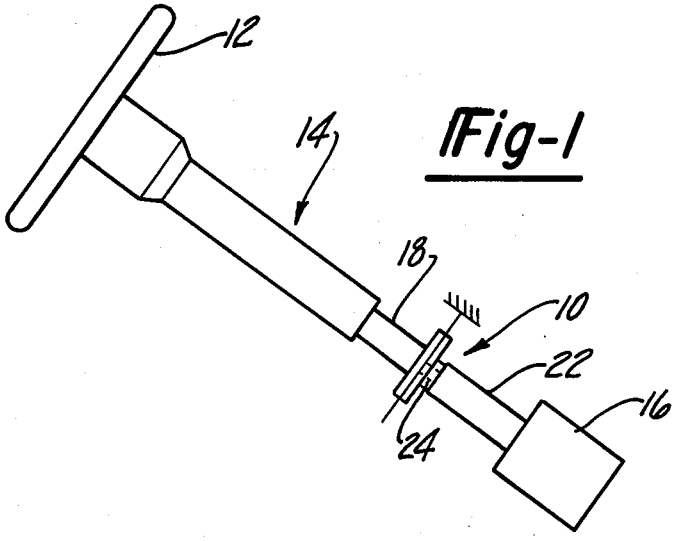
FIG. 1 shows a typical installation of the transducer of this invention in a steering column of an automotive vehicle.

Referring now to the drawings, there is shown an illustrative embodiment of the invention in an angular displacement transducer especially adapted for use in a power steering system. This embodiment represents a particular design, including a particular configuration and structure, especially suited for such an application. It will be appreciated, as the description proceeds, that the invention may be embodied in other designs and used in other applications.

FIG. 1 of the drawings shows the transducer 10 of this invention installed in a typical automotive power steering system. In general, the steering system comprises a steering wheel 12 which is connected through a steering column 14 to a steering gear 16. The steering gear 16 is operatively connected with the dirigible wheels of the vehicle for displacing the wheels in accordance with the rotative position of the steering wheel 12. The steering system is provided with a servo system drive connection and, for failsafe purposes, a manual drive connection. The steering column 14 includes an upper steering shaft 18 and a lower steering shaft 22 which are connected together by a torsion shaft 24. The torsion shaft 24 is of reduced diameter and is torsionally elastic so that it twists when the steering wheel 12 is turned by the driver. The upper and lower shafts 18 and 22 are also interconnected by a lost-motion connection (not shown) which limits the amount of twist of the torsion shaft 24 and provides an unyielding coupling between the shafts 18 and 22. Thus, the manual drive connection for the dirigible wheels extends through the upper shaft 18, the lost-motion connection and the lower shaft 22 to the steering gear 16 and thence to the dirigible wheels. In the power steering mode of operation, the turning effort by the driver on the steering wheel 12 causes the torsion shaft 24 to twist corresponding to the amount of torque applied by the driver. This produces a relative rotation between the upper shaft 18 and the lower shaft 22. The resisting torque of the torsional shaft imparts to the driver an indication of the force applied to the wheels and is called "road feel". The transducer 10 is adapted to produce an electrical signal corresponding to the relative angular displacement between the upper and lower shafts 18 and 22. This signal is used for controlling a servo motor (not shown) which is connected through the drive gear 16 to the dirigible wheels. When the servo motor displaces the dirigible wheels, the lower shaft 22 is also displaced so that there is relative movement between the shafts 22 and 18 tending to nullify the signal generated by the transducer 10.

Figure 2:
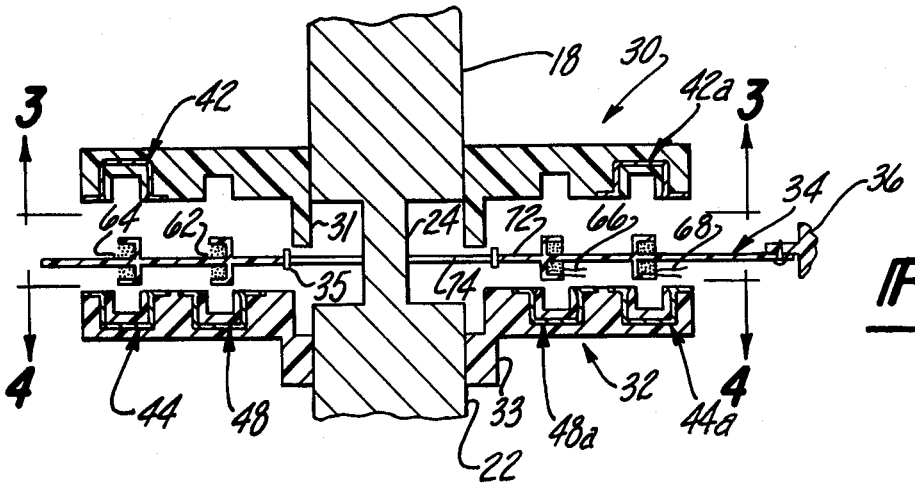
FIG. 2 is a cross-sectional view of the transducer of this invention.
Figure 13:
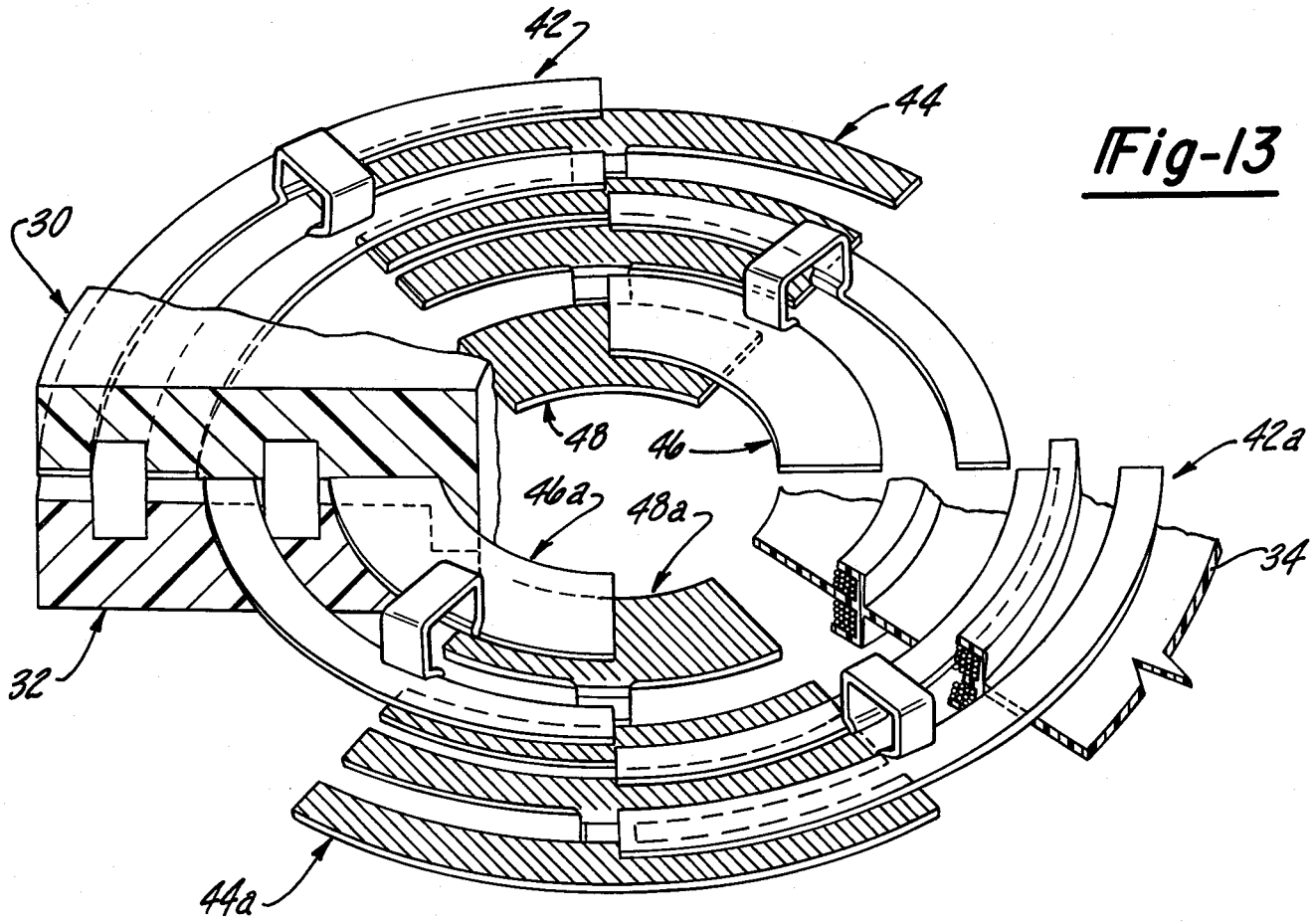
FIG. 13 is a perspective view of the transducer with parts broken away.

The transducer of this invention will now be described with particular reference to FIGS. 2, 3, 4 and 13. For clarity the transducer is shown in FIGS. 2 and 13 in exploded views. It comprises, in general, a pair of relatively rotatable members or rotors 30 and 32 and a stationary coil holder 34 disposed between the rotors. The rotor 30 is mounted by a hub 31 on the upper shaft 18 for rotation therewith and the rotor 32 is mounted by a hub 33 on the lower shaft 22 for rotation therewith. The coil holder 34 is mounted on a stationary housing 36 of the steering column. In the assembly of the transducer, the rotors are mounted in closely spaced relation with the coil holder 34 so that the space between the rotors is minimized.

In general, the rotors 30 and 32 each includes a first and second set of magnetic circuits each of which exhibits a reluctance which varies with the angular position of the rotors. The reluctances are sensed by first and second inductance coils 64 and 62 associated with electric circuits for developing an electrical signal corresponding to angular displacement. The magnetic circuits and inductance coils will be described more specifically subsequently.

The rotors 30 and 32 include a first set of magnetic cores comprising cores 42 and **42*a* on rotor 30 and cores 44 and 44*a* on rotor 32. Similarly, the rotors 30 and 32 include a second set of magnetic cores comprising cores 46 and 46*a* on rotor 30 and cores 48 and 48*a* on rotor 32. Cores 42 and 44 in the first set constitute a pair of cores which are adapted to coact with each other to provide a magnetic circuit with an air gap therebetween. The term "air gap", as used herein, means the space between pole faces of magnetic cores of a magnetic circuit whether such space is occupied by air or other low permeability material. Likewise, cores 42*a* and 44*a* in the first set constitute a pair of cores which are adapted to coact with each other to provide a magnetic circuit with an air gap therebetween. Similarly, cores 46 and 48 in the second set constitute a pair of cores and cores 46*a* and 48*a*** in the second set constitute a pair of cores.

The coil holder 34 supports an inner winding or conductor coil 62 and an outer winding or conductor coil 64. Both coils are circular and are supported on the coil holder 34 in a stationary position. The inner coil 62 terminates in a pair of lead wires 66 and the outer coil 64 terminates in a pair of lead wires 68. The coil holder 34 is preferably a printed circuit board 72 having a central opening 74 to provide clearance for the hub 31 of rotor 30. The board 72 is suitably fitted with an annular bearing 35. As noted above, the coil holder 34 is mounted in a stationary position on the housing part 36. Each of the coils 62 and 64 is mounted on the printed circuit board 72 in a symmetrical manner, i.e. half of the coil is disposed on one side of the board and half on the other. It is noted, however, that each of the coils could be mounted asymmetrically with the entire coil on one side of the board. Certain electronic circuits such as that to be described with reference to FIG. 9, may be advantageously located on the printed circuit board 72. It is further noted that each of the coils 62 and 64 may take the form of printed circuit coils, i.e. conductor paths printed on the board 72 instead of being wire-wound coils.

Figure 3:
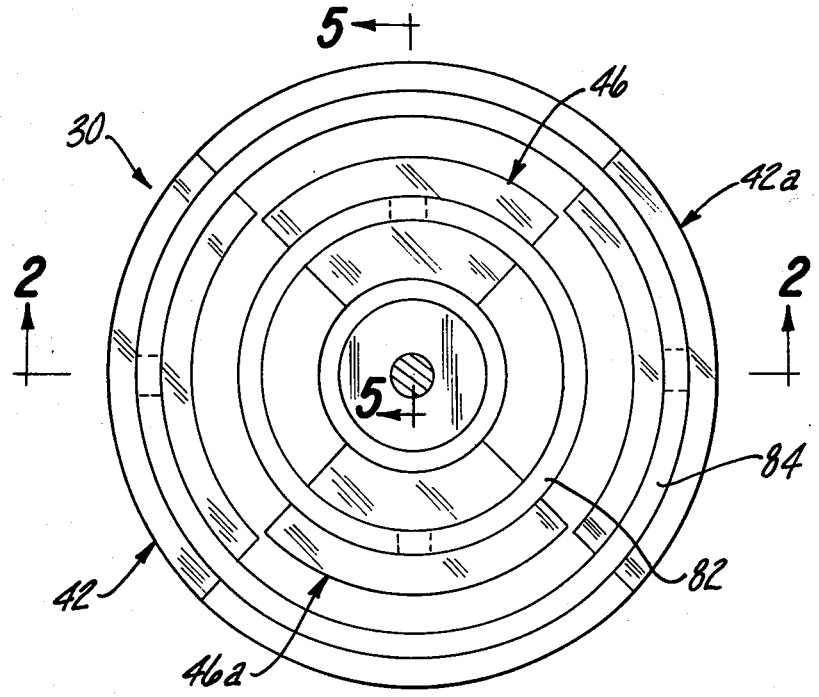
FIG. 3 is a view of the face of one rotor of the transducer, the view being taken on line 3—3 of FIG. 2.
Figure 5:
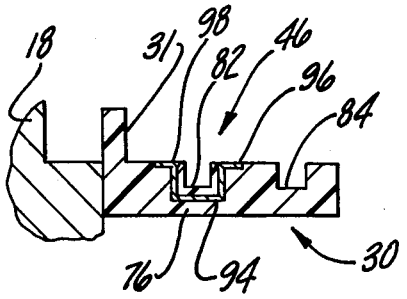
FIG. 5 is a view taken on line 5—5 of FIG. 3.

The structure of the rotor 30 will be described further with reference to FIG. 5 taken in conjunction with FIGS. 2 and 3. The rotor 30 comprises a circular disk 76 constructed of plastic. The disk includes the hub 31 for mounting the rotor on shaft 18 for rotation therewith. The face of the rotor 30 is provided with an inner groove 82 and an outer groove 84 both of which are circular and coaxial with respect to the circular hub 31. The grooves 82 and 84 are adapted to provide clearance for the inner and outer coils 62 and 64, respectively. The coils are nested in their respective grooves without engagement with the rotor 30.

Figure 7:
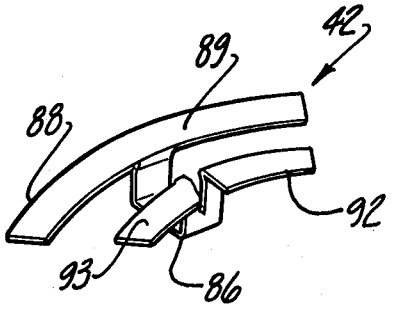
FIG. 7 is a perspective view of one core.

As described above, the rotor 30 includes cores 42 and **42*a* and cores 46 and 46*a*. Core 42 will be described with reference to FIG. 7, taken in conjunction with FIGS. 2 and 3. Core 42*a* is identical to core 42. Core 42 comprises a unitary body of ferromagnetic sheet metal which is suitably formed by a stamping operation. The core includes a core body or U-shaped bridge 86 terminating in a pair of arcuate pole pieces 88 and 92 with pole faces 89 and 93, respectively. As used herein, the term "U-shaped" means any shape adapted for conducting magnetic flux around an electric conductor. The bridge 86 is narrow relative to the arc length of the pole pieces. The bridge 86 is folded under the pole pieces in a manner which increases the separation of the bridge from the coil 64 thus diminishing the proximity effects. The core 42 is mounted on the face of the rotor 30 with the bridge 86 providing a low reluctance path around the outer groove 84. The core 42*a* is mounted in the same way on the face of the rotor 30 at a position diametrically opposite the core 42**.

The core 46 and **46*a* on the rotor 30 are similar in construction to the core 42. Cores 46 and 46*a* are identical to each other. Core 46 comprises a U-shaped bridge 94 which terminates in arcuate pole pieces 96 and 98 having pole faces 97 and 99, respectively. The bridge is narrow relative to the arc length of the pole pieces. The core 46 is mounted on the face of the rotor 30, as shown in FIG. 3, with the bridge 94 providing a low reluctance path around inner groove 82. The core 46*a* is mounted on the rotor 30 in the same manner in a position diametrically opposite core 46**.

Figure 4:
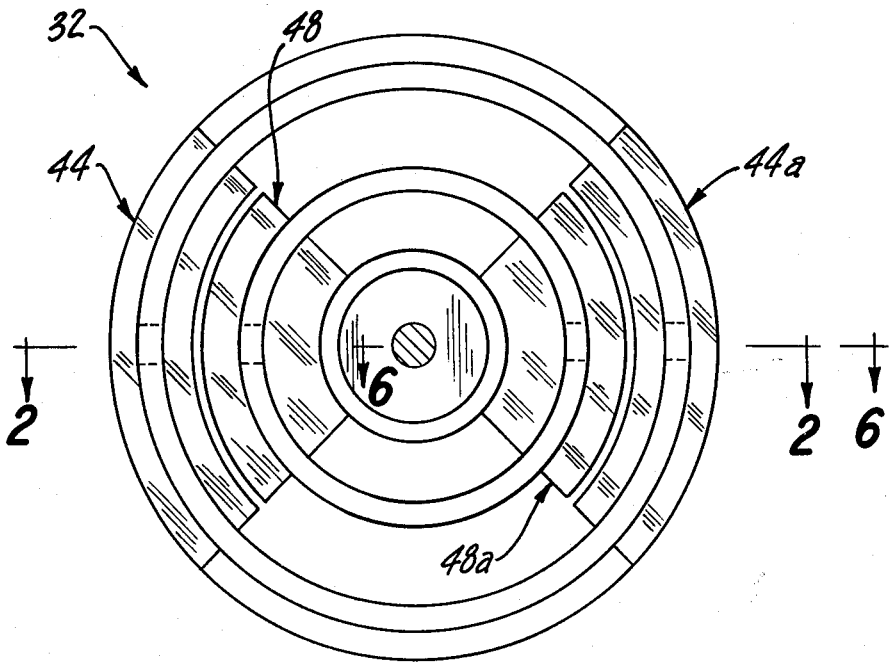
FIG. 4 is a view of the face of the other rotor of the transducer, the view being taken on line 4—4 of FIG. 2.
Figure 6:
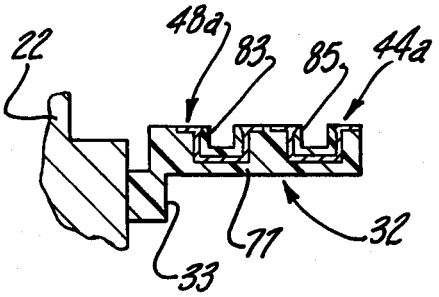
FIG. 6 is a view taken on line 6—6 of FIG. 4.

The structure of the rotor 32 will be described further with reference to FIG. 6 taken in conjunction with FIGS. 2 and 4. The rotor 32 comprises a circular disk 77 constructed of plastic and having the hub 33 for mounting the rotor on shaft 22 for rotation therewith. The face of the rotor 32 is provided with an inner groove 83 and an outer groove 85 both of which are circular and coaxial with respect to the hub 33. The coils 62 and 64 are nested in the grooves 83 and 85, respectively, without engagement with the rotor 32.

Figure 8:
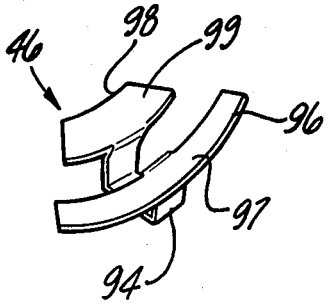
FIG. 8 is a perspective view of another core.

As described above, the rotor 32 includes cores 44 and **44*a* and cores 48 and 48*a*. Cores 44 and 44*a* are identical in construction to core 42 described above. Cores 48 and 48*a* are identical in construction to core 46 described above. As a variation, cores 44 and 48 may be made of one piece, e.g. from a unitary body of sheet metal, with the adjacent pole pieces (corresponding to 92 and 96 in FIGS. 7 and 8) joined together. The same would apply to cores 44*a* and 48*a***. This construction may be advantageous for manufacturing purposes.

Preferably, the disks of rotors 30 and 32 are made by injection molding with all of the cores molded in place. It is noted that the surfaces of all of the pole faces on each rotor lie in the same plane on the face of the respective rotor disk. The cores are held in place by adherence to and inclusion within the molded plastic.

Figure 10:
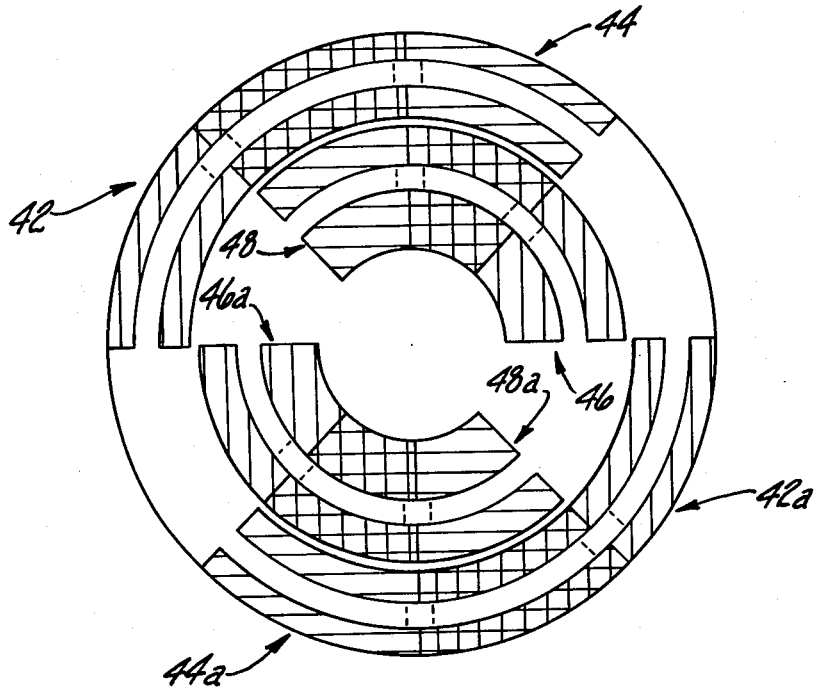
FIGS. 10 and 11 are schematics showing the rotors of the transducer in different positions.

The cores 42 and 44 coact with each other to provide a first variable reluctance magnetic circuit and the cores **42*a* and 44*a* coact with each other to provide a second variable reluctance magnecit circuit for the inductance coil 64. Similarly, cores 46 and 48 coact with each other to provide first variable reluctance magnetic circuit and core 46*a* and 48*a* coact with each other to provide a second variable reluctance magnetic circuit for inductance coil 62. For explanatory purposes, the magnetic circuits are shown in schematic fashion in FIGS. 10 and 11. FIG. 10 shows the pole faces with the rotor disks 30 and 32 in a reference position relative to each other. The view of FIG. 10 shows the pole faces of rotors 30 and 32. The exposed portions of the pole faces are shown with single cross-hatching and the overlapped portions are shown with double cross-hatching. In this reference position, one-half of the pole faces of cores 44 and 42 overlap and similarly one-half of the pole faces of cores 44*a* and 42 overlap. In the same manner, one-half of the pole faces of cores 48 and 46 overlap and one-half of the pole faces of cores 48*a* and 46*a* overlap. In this reference position, the inductance of coil 62 is substantially equal to the inductance of coil 64**. For symmetry, the coils may be designed to have substantially equal resistance.

FIG. 13 shows the rotor disks 30 and 32 in the same reference position as shown in FIG. 10. In FIG. 13, the pole faces on disk 32 are shown with cross-hatching and the pole faces on disk 30 are shown without cross-hatching.

It is to be noted that rotation of rotor 32 relative to rotor 30 in a counterclockwise direction, as viewed in FIG. 10, will increase the face-to-face overlap of cores 44 and 42 and cores **44*a* and 42*a* thereby decreasing the reluctance of the respective magnetic circuits and increasing the inductance of the coil 64. This same relative rotation, however, will decrease the face-to-face overlap of cores 46 and 48 and cores 46*a* and 48*a* thereby increasing the reluctance of the respective magnetic circuits and decreasing the inductance of the coil 62. It will be understood that relative rotation in the opposite sense of the rotor disks 30 and 32 will cause the opposite effect so that the inductance of coil 62 is increased and the inductance of coil 64** is decreased.

Figure 11:
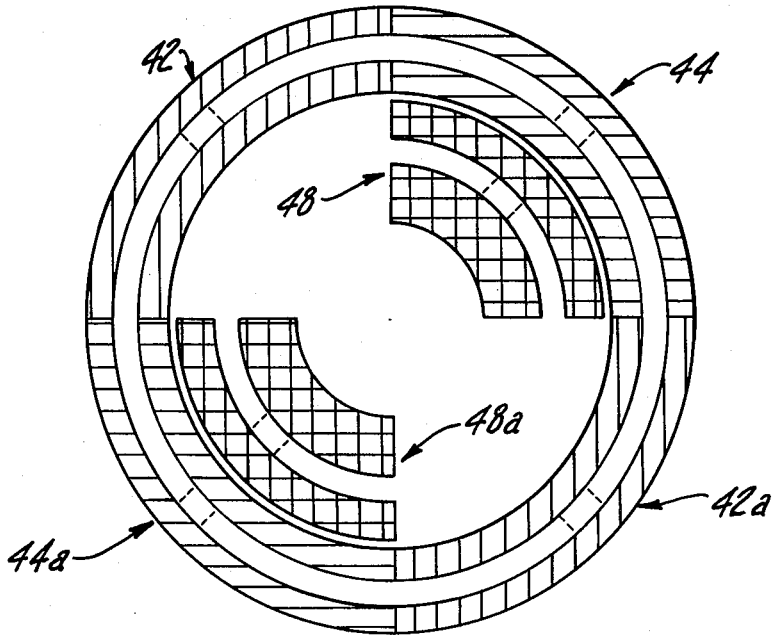

With the rotor disks 30 and 32 in the relative position shown in FIG. 11, the inductance of coil 62 is at a maximum value and the inductance of coil 64 is at minimum value. In this condition, the overlap of cores 46 and 48 and cores 46*a* and 48*a* is at a maximum value and the overlap of the cores 42 and 44 and cores 42*a* and 44*a* is at a minimum or zero overlap. As will be appreciated, relative rotation of the rotor disks 30 and 32 through forty-five degrees from the position shown in FIG. 10 to the position shown in FIG. 11 causes a continuous variation of the inductance of coil 62 from its value at the reference position to a maximum value and the inductance of coil 64 is varied from its value at the reference position to its minimum value. It will now be appreciated that rotation of rotor disks 30 and 32 in the opposite sense from the reference position will cause the inductance coil 62 to decrease to its minimum value and the inductance of coil 64 to increase to its maximum value.

Figure 12:
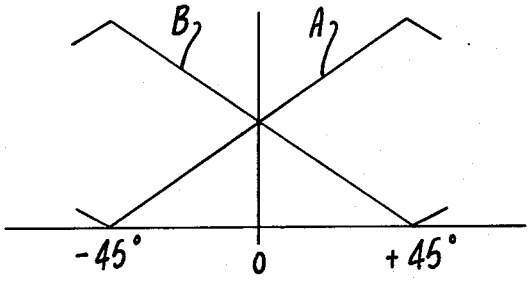
FIG. 12 is a graph for aid in explanation.

A graphical representation of the variation of the inductance of coils 62 and 64 is shown in FIG. 12. This graph depicts an idealized functional relationship in which the inductance varies linearly with relative angular displacement, i.e. with area of pole face overlap, for explanatory purposes. The linear relationship would be achieved only with magnetic core material of zero reluctance and with a very small air gap. In practice, such a relationship may be only approximated; other functional relationships may be obtained between inductance and angular displacement, as desired, by appropriate design. Since the reluctance varies approximately inversely with the area of pole face overlap, this may be achieved by using pole faces of different shapes. Referring to FIG. 12, curve A represents the inductance of coil 62 and curve B represents the inductance of coil 64. Relative angular displacement is plotted on the abscissa axis and the inductance value is plotted on the ordinate axis of the graph. With the rotors 30 and 32 in the reference position, as depicted in FIG. 10, the inductances of coils 62 and 64 are equal to each other. As rotor 32 is rotated clockwise relative to rotor 30, as seen in FIG. 10, the inductance of coil 62 increases to its maximum value and the inductance of coil 64 decreases to its minimum value at an angular displacement of positive forty-five degrees. When the relative rotation of rotor 32 is counterclockwise relative to disk 30, as viewed in FIG. 10, the inductance of coil 62 decreases from its reference value to its minimum value and the inductance of coil 64 increases from its reference value to its maximum value at an angular displacement of negative forty-five degrees.

Figure 9:
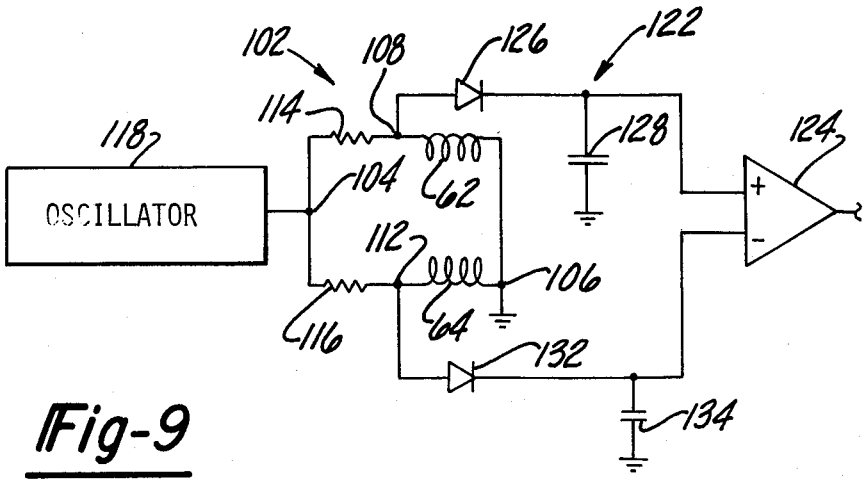
FIG. 9 shows a circuit which may be used with the transducer.

A circuit for developing an electrical signal corresponding to the relative angular displacement of rotors 30 and 32 is shown in FIG. 9. For this purpose, the coils 62 and 64 are connected in a bridge circuit 102. A bridge circuit has a pair of input terminals 104 and 106 and a pair of output terminals 108 and 112. The bridge circuit comprises a resistor 114 connected serially with the coil 62 between the input terminals 104 and 106 and a resistor 116 connected serially with the coil 64 between the input terminals 104 and 106. The bridge circuit is excited by an oscillator 118 connected across the input terminals 104 and 106. The output terminals of the bridge circuit are connected through a detector circuit 122 to a differential amplifier 124. The detector circuit includes a series diode 126 and a parallel capacitor 128 connected between the output terminal 108 of the bridge circuit and one input terminal of the amplifier 124. It also includes a series diode 132 and a parallel capacitor 134 connected between the output terminal 112 of the bridge circuit and the other input terminal of the amplifier 124.

The circuit of FIG. 9 is operative to develop an output signal from amplifier 124 which corresponds in polarity and magnitude with the direction and extent of relative angular displacement between the rotors 30 and 32 of the transducer. When the rotors 30 and 32 are in the reference position, the inductances of coils 62 and 64 are equal to each other and the bridge circuit 102 is balanced. Accordingly, the detector voltages applied to the input terminals of the amplifier 124 are equal and the output of the amplifier is zero. When the rotor 32 is rotated clockwise relative to rotor 30, as viewed in FIG. 10, the inductance of coil 62 increases and the inductance of coil 64 decreases. Accordingly, the bridge circuit produces a greater voltage at output terminal 108 than at output terminal 112 and the amplifier 124 produces a positive voltage corresponding to the extent of angular displacement of the rotors. When the rotor 32 is rotated counterclockwise relative to disk 30, as viewed in FIG. 10, inductance of coil 64 increases and the inductance of coil 62 decreases. Accordingly, the bridge circuit produces a larger voltage at output terminal 112 than at output terminal 108 and accordingly the amplifier 124 produces the negative voltage corresponding to the extent of angular displacement. The bridge circuit of FIG. 9 is suited for developing an electrical signal from the transducer of this invention; however, the circuit, per se, is not a part of this invention and other circuits may be utilized in conjunction with the transducer of this invention.

It will now be appreciated that the transducer of this invention produces a displacement signal which varies according to a predetermined function of relative angular displacement of the rotors but which is substantially invariant with other relative motions between the rotors. For example, if the rotors should be displaced axially relative to each other, by reason of loose bearings, the angular displacement signal would be minimally affected because the inductances of coils 62 and 64 would both change in the same sense so that the balance of the bridge circuit would be minimally affected. Similarly, a relative transverse motion or tilting motion would have minimal effect on the angular displacement signal. It is also noted that the transducer is substantially immune to temperature variations since both coils are subject to the same temperature change and the balance of the bridge circuit is unaffected. It is noted that these advantages are obtained in the illustrative embodiment described herein; while the illustrative embodiment of the cores are arranged to provide two separate magnetic circuits in each set, it will be understood that two or more magnetic circuits in each set may be utilized. A greater number of magnetic circuits results in a lesser angle of rotation between maximum and minimum reluctance. Also, an arrangement with one magnetic circuit in each set may be useful in certain applications although it does not provide the same degree of immunity to disturbances as described above.

Although the description of this invention has been given with reference to a particular embodiment, it is not to be construed in a limiting sense. Many variations or modifications of the invention will now occur to those skilled in the art. For a definition of the invention reference is made to the appended claims.

What is claimed is:

1. An angular displacement transducer of the variable reluctance type comprising, first and second members having opposed faces and having a common axis of symmetry, at least one of said members being rotatable about said axis, a first and second set of cores, one-half of each set being on the first member and one-half of each set being on the second member, each core terminating in spaced pole faces, a pair of cores in the first set, one on each member, coacting with each other to provide a first magnetic circuit with an air gap between the pole faces thereof, a pair of cores in the second set, one on each member, coacting with each other to provide a second magnetic circuit with an air gap between the pole faces thereof, a first conductor coil disposed adjacent each pair of cores of the first set and magnetically linked with the magnetic circuit thereof, a second conductor coil disposed adjacent each pair of cores of the second set and magnetically linked with the magnetic circuit thereof, the pole faces of each pair of cores of the first set being positioned on the respective first and second members so that relative rotation of said members from first to second predetermined angular positions causes the degree of face-to-face overlap of said pole faces to decrease, whereby the reluctance of the magnetic circuit of each pair of cores is increased, the pole faces of each pair of cores of the second set being positioned on the respective first and second members so that relative rotation of said members from said first to said second predetermined angular position causes the degree of face-to-face overlap of said pole faces to increase, whereby the reluctance of the magnetic circuit of each pair of cores is decreased.

2. The invention as defined in claim 1 wherein said coils are stationary.

3. The invention as defined in claim 1 wherein there are a plurality of pairs of cores in the first set and a plurality of pairs of cores in the second set.

4. The invention as defined in claim 1 wherein, said first and second members have axially opposed faces in axially spaced relation, the pole faces of each core being faced in the axial direction and being spaced in the radial direction.

5. The invention as defined in claim 3 wherein the cores in each set are spaced equidistantly in the circumferential direction.

6. The invention as defined in claim 1 wherein the magnetic circuits formed by the pairs of cores in the first set are physically separated from the magnetic circuits formed by the pairs of cores in the second set.

7. The invention as defined in claim 1 wherein each core comprises a sheet of ferromagnetic material including a U-shaped member terminating in a pair of pole faces.

8. The invention as defined in claim 1 wherein, each core comprises two pole pieces joined by at least one U-shaped bridge, each pole piece of said core being a thin plate, said bridge being narrow relative to said pole piece.

9. In an angular displacement transducer of the variable reluctance type, first and second members having opposed faces and having a common axis of symmetry, at least one of said members being rotatable about said axis, and having opposed faces with space therebetween, first and second magnetic cores on the first and second members, respectively, and coacting with each other to form a magnetic circuit, a conductor coil disposed adjacent the first and second cores and being magnetically linked therewith, at least one said core comprising two pole pieces joined by at least one bridge which is narrow relative to the largest dimension of either pole piece, each pole piece of said core being a thin plate, the pole pieces of said first core being disposed across an air gap from the pole pieces of said second core, said pole pieces being oriented on said members so that the reluctance of the magnetic circuit is varied by relative angular displacement of said members.

10. The invention as defined in claim 9 wherein there are two of said magnetic circuits disposed so that rotation from a reference position causes the reluctance of one circuit to increase and the reluctance of the other circuit to decrease.

11. The invention as defined in claim 9 wherein there are a plurality of cores in each magnetic circuit.

* * * * *